US005393113A

United States Patent [19]

Walsh

[11] Patent Number: 5,393,113

[45] Date of Patent: Feb. 28, 1995

[54] HANDLE ATTACHMENT FOR CHEST DRAINAGE UNIT

[75] Inventor: Robert P. Walsh, St. Peters, Mo.

[73] Assignee: Sherwood Medical Company, St. Louis, Mo.

[21] Appl. No.: 138,529

[22] Filed: Oct. 15, 1993

[51] Int. Cl.[6] ..... A45F 5/00; A61G 12/00

[52] U.S. Cl. ..... 294/170; 294/27.1

[58] Field of Search ..... 294/27.1, 137, 170, 294/171; 604/317-320

[56] References Cited

U.S. PATENT DOCUMENTS

| | | | |
|---|---|---|---|
| 270,917 | 1/1883 | Turner | 294/170 |
| 3,679,103 | 7/1972 | Chmela et al. | 294/170 X |
| 5,181,757 | 1/1993 | Montoya | 294/170 X |

FOREIGN PATENT DOCUMENTS

| | | | |
|---|---|---|---|
| 2541099 | 8/1984 | France | 294/170 |
| 9111368 | 8/1991 | WIPO | 294/170 |

*Primary Examiner*—Dean J. Kramer
*Attorney, Agent, or Firm*—Andrew J. Beck; Montgomery W. Smith; David A. Warmbold

[57] ABSTRACT

A handle attachment for use with a chest drainage unit (CDU) having a pair of hangers extending above the CDU to support the CDU on a bedrail or the like. The handle attachment being used to capture both CDU hangers to allow the CDU to be transported within a medical facility by the necessary medical personnel in an easy, one-handed manner.

1 Claim, 1 Drawing Sheet

HANDLE ATTACHMENT FOR CHEST DRAINAGE UNIT

BACKGROUND OF THE INVENTION

1. Field of the Invention invention relates to a handle attachment for a chest drainage unit and relates more specifically to a handle attachment for capturing a pair of hangers of a chest drainage unit to allow for easy, one-handed, transport within a medical facility by appropriate medical personnel.

2. Description of Related Art

Chest drainage units (CDUs) are used to collect and measure fluids and other materials from a patient's chest during and after surgery and as a result of injury to the patient's chest. It is important to be able to safely transport such units within a medical facility without tipping or spilling the liquid and other materials from the container. It is also beneficial for medical personnel to be able to transport the CDUs with the use of only one hand so that their second or other hand is available to open doors and/or hold other miscellaneous equipment associated with the CDU.

During use, many CDUs are suspended by a pair of hangers from a bedside rail. Referring to FIG. 1, a typical CDU is shown and designated at 10. A pair of rigid hangers 12 and 14 connect CDU 10 to a bedrail 16 (shown in dashed outline) or similar such support. Usually, the pair of hangers 12 and 14 support the CDU 10 on a bedrail from opposite ends of a top surface 18 at mounts 20 and 22, respectively of CDU 10 as shown in FIG. 1.

Hangers 12 and 14 typically would have a distal curved end 24 that would extend around the bedrail 16 or such similar support, and a proximal pivot end 26 that is pivotally attached to the CDU 10 at mounts 20 and 22, respectively. The term "proximal" is meant to refer to that end of the hanger which is closest to the CDU and "distal" to that end of the hanger which is farthest from the CDU. The hangers 12 and 14 are allowed to rotate on their pivot end 26 in all directions such that the curved end 24 of hangers 12 and 14 can move in generally parallel directions or towards and away from each other as is needed.

When transporting the CDU 10, the unit can be carried from underneath its body by two hands or each of the curved ends 24 of hangers 12 and 14 can be grasped to support the unit. Medical personnel could attempt to grasp both curved ends 24 of hangers 12 and 14 in one hand, however, this has been found to be difficult because when the CDU is full of liquid it weighs approximately ten pounds and the hangers 12 and 14 will bite into the carrier's hand sufficiently to cause discomfort. It is therefore, desirable to provide a handle attachment for readily grasping the ends of hangers 12 and 14 to allow medical personnel to transport the CDU with the use of only one hand in a safe manner.

Various prior art devices have utilized a molded handle in the top surface of the CDU for transporting the CDU. However, such a design would require that a specialized mold be made to form the body of such a CDU which would entail a significant expense. Furthermore, when transporting a CDU having a molded handle in its top surface (not shown), the hangers 12 and 14 are left to dangle at the sides of the CDU thereby creating a significant danger of having the curved hanger ends 24 catching on foreign objects while the CDU is being transported through the medical facility.

SUMMARY OF THE INVENTION

In accordance with the present invention, a handle attachment for a chest drainage unit (CDU) is provided which allows for easy, one-handed, transport of the CDU by medical personnel within a medical facility. More specifically, a handle attachment is provided having a pair of slots for receiving the ends of a pair of hangers provided with the CDU for supporting the CDU on a bedrail or the like. The handle's slots include a detent for securely retaining the hanger ends within the confines of the slot to prevent the hangers from accidentally slipping off the handle during transportation.

It is therefore an object of the invention to provide a handle attachment for use with a CDU having a pair of hangers for easy, one-handed, transportation of the CDU within a medical facility.

It is a further object of the invention to provide a handle attachment having at least one slot for receiving a hanger from a CDU device for providing easy, one-handed, transportation of the CDU within a medical facility.

It is yet another object to provide a handle attachment for a CDU having a pair of slots for receiving the hangers of a CDU device wherein the slots are provided with a mechanism for securely retaining the hanger within the slot of the handle attachment.

And, it is yet another object to provide a handle attachment for use with existing CDU devices that are currently being used in medical facilities around the country to allow for the easy, one-handed, transportation of such existing CDU devices within such medical facilities without costly replacement or reworking of such CDU devices.

These and other objects of the invention will be made clear from the description contained herein and, more particularly, with reference to the following detailed description of the invention and the accompanying drawings.

BRIEF DESCRIPTION OF THE DRAWINGS

FIG. 1 is a perspective view of a typical chest drainage unit (CDU) being supported on a bedrail or the like.

DETAILED DESCRIPTION OF THE INVENTION

Figure 1:
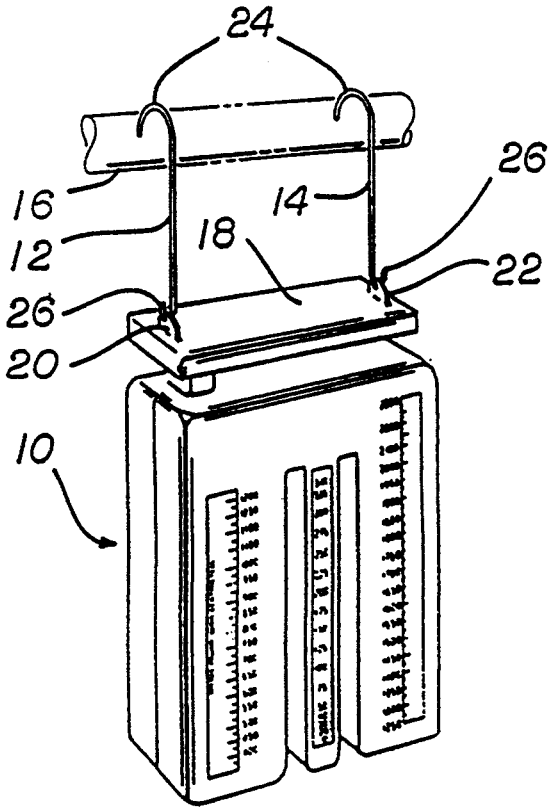
FIG. 1 (PRIOR ART)
Figure 3:
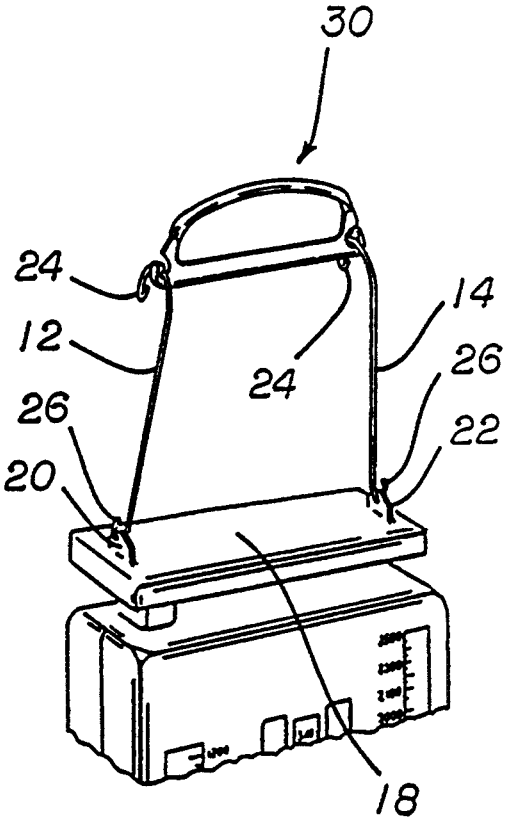
FIG. 3 is a perspective view of the handle attachment of FIG. 2 in use with a CDU in preparation for easy, one-handed, transportation of the CDU.

In the description that follows, like elements, whether described above or below, are referred to with like reference numbers. Referring now to the drawing in more detail and initially to FIG. 1, a typical chest drainage unit (CDU) is shown and designated at 10. The CDU 10 is shown supported on a bedrail 16 or the like so that the CDU can be conveniently located near a medical patient who may require its use. Obviously, the CDU could be supported by any convenient medical instrument or piece of furniture which is normally located within a convenient distance to a medical patient who needs the use of the CDU.

The CDU 10 usually has a pair of hangers 12 and 14 which connect to a top surface 18 of the CDU 10. The top surface 18 is provided with a pair of hanger mounts 20 and 22 which receive a proximal pivoting end 26 of hangers 12 and 14 such that the hangers are allowed to rotate in all directions. The opposite or distal ends of hangers 12 and 14 are provided with a curved end 24 that would extend around a bedrail 16 or such similar support.

The hangers 12 and 14 are shown being pivotally attached to the top surface 18 of CDU 10, however it is also possible that the pivot end 26 of hangers 12 and 14 would be attached to the upper sides of the CDU as long as such hangers are allowed relatively free movement such that their distal free ends are allowed sufficient movement to connect to the invention as discussed below.

Figure 2:
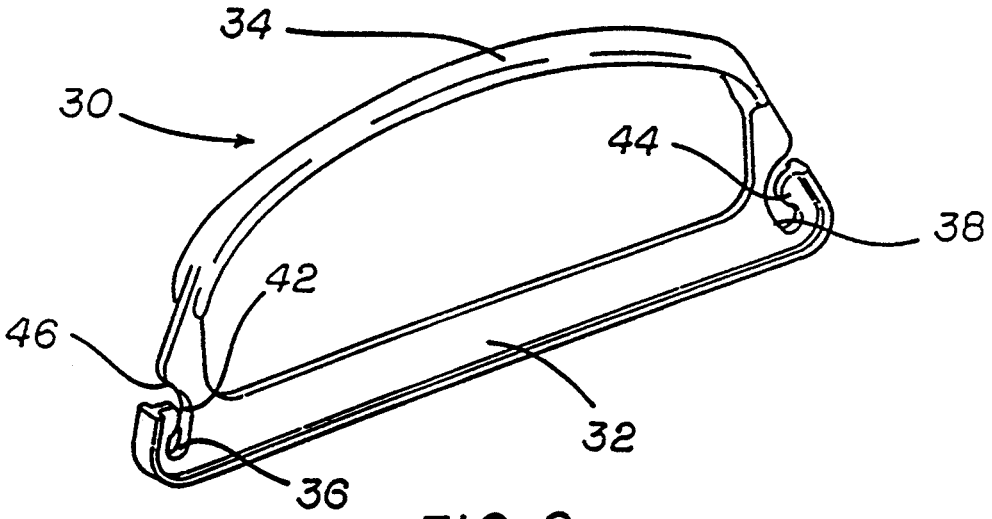
FIG. 2 is a perspective view of a handle attachment of the preferred embodiment of the invention.

Referring now to FIG. 2, a handle 30 is illustrated for use with the CDU 10 of FIG. 1. Handle 30 includes a rigid main support member 32 and an arcuate top grasping member 34. The top grasping member 34 can be of any geometric shape however for the preferred embodiment shown in FIG. 2 an arcuate shape is shown.

Support slots 36 and 38 are provided at either end of the main support member 32 which are designed to receive the curved ends 24 of hangers 12 and 14, respectively. Support slots 36 and 38 are identical except that they are reversed in orientation and the following description applies to both slots 36 and 28. Slots 36 and 28 have a generally upside down "L" shape configuration with the short arm 40 of the "L" shape forming the entrance to the slot and the long arm 42 of the "L" shape defining a depending slot for receiving the curved end 24 of hangers 12 and 14, respectively. On the inside angle of each "L" shaped slot, an inwardly extending detent 44 is provided which assists in securely holding the curved ends 24 of hangers 12 and 14 within the slots 36 and 38 so that the CDU 10 can be easily and safely transported within the medical facility.

The handle 30 can be manufactured out of any material of sufficient rigidity to support approximately ten pounds. The preferred embodiment is shown manufactured out of a medical grade plastic, however, the handle could also be manufactured out of any lightweight metal such as aluminum or a lightweight stainless steel.

The curved ends 24 of hangers 12 and 14 have been described as being arcuate in shape, however, it is possible that these ends could have any shape (i.e., squared with a notch or triangular) with would allow the shaped ends to be captured within the support slots 36 and 38 of handle 30.

In operation, a medical technician would use handle 30 to assist in transporting a CDU 10 within the medical facility. After a CDU has been used by a patient such that it is full of a discharge fluid, the technician would grasp the handle 30 by its grasping member 32 and place the curved end 24 of each hanger 12 and 14 into the support slots of handle 30 until a distinctive "click" is heard. At this time, the technician would know that the curved ends 24 of hangers 12 and 14 have been securely positioned within support slots 36 and 38 past the detents 42 provided therein. The technician would then be allowed to transport the CDU 10, which weighs approximately ten pounds, through the medical facility with the use of only one hand until the technician has reached a medical laboratory or fluid disposal point within the medical facility where the contents of the CDU can be emptied. During transportation, the technician would have his/her other hand available to open doors and/or carry other necessary medical equipment as is required.

The detailed description of the preferred embodiment of the invention having been set forth herein for the purposes of explaining the principles thereof, it is known that there may be modifications, variations or changes in the invention without departing from the proper scope of the invention as defined by the claims attached hereto. Accordingly, it is not intended that the invention be limited, except as by the appended claims.

I claim:

1. A method of transporting a chest drainage unit within a medical facility by medical personnel using only one hand, the method including the steps of:

providing a chest drainage unit having a substantially hollow body in fluid flow communication with the body of a patient wherein liquid from the patient's body will be collected, the hollow body having a pair of hangers extending above the chest drainage unit for attachment to a support device within the medical facility;

providing a handle having a base support member, an upwardly extending arcuate grasping member and base support member, and a pair of slots at opposite ends of said base support member;

placing a distal end of each chest drainage unit hanger within the confines of a respective handle slot;

placing the fingers of one hand within the open central area and grasping the arcuate grasping member; and transporting the chest drainage unit within the medical facility in an easy, one-handed fashion while having the other hand free to assist in opening doors and the like.

* * * * *